United States Patent [19]

Künzli

[11] Patent Number: 4,577,091

[45] Date of Patent: Mar. 18, 1986

[54] TRAY ELECTRODE ARRANGEMENT FOR AN ELECTRICAL STEAM OR HOT WATER GENERATOR

[75] Inventor: Albert Künzli, Wiesendangen, Switzerland

[73] Assignee: Sulzer Brothers Limited, Winterthur, Switzerland

[21] Appl. No.: 639,336

[22] Filed: Aug. 10, 1984

[30] Foreign Application Priority Data

Aug. 11, 1983 [CH] Switzerland ..... 4388/83

[51] Int. Cl.[4] ..... H05B 3/60; F22B 1/30

[52] U.S. Cl. ..... 219/284; 219/288; 219/289; 219/294; 338/80

[58] Field of Search ..... 219/271–275, 219/284–295; 338/80–86; 122/4 A

[56] References Cited

U.S. PATENT DOCUMENTS

| | | | |
|---|---|---|---|
| 4,101,758 | 7/1978 | Sprague | 219/289 X |
| 4,109,137 | 8/1978 | Zabelka | 219/288 X |
| 4,121,090 | 10/1978 | Kuenzli | 219/288 X |
| 4,169,558 | 10/1979 | Coates | 219/288 X |
| 4,206,342 | 6/1980 | Kuenzli | 219/288 X |

FOREIGN PATENT DOCUMENTS

| | | | |
|---|---|---|---|
| 168622 | 7/1951 | Austria | 219/284 |
| 685856 | 12/1939 | Fed. Rep. of Germany | 219/284 |
| 728299 | 11/1942 | Fed. Rep. of Germany | 219/288 |
| 518502 | 1/1921 | France | 219/288 |
| 45088 | 4/1928 | Norway | 219/286 |

*Primary Examiner*—A. Bartis

*Attorney, Agent, or Firm*—Kenyon & Kenyon

[57] ABSTRACT

The electrical steam generator has a pressure vessel in which pairs of trays are disposed one above the other on a vertical riser. The bottom tray of each pair of trays is electrically insulated from the pressure vessel wall and is connected to a power supply while the top trays of each tray pair are electrically connected to the pressure vessel wall through the riser. The trays each have a peripheral overflow edge and are disposed so that water flows over the overflow edge in the form of a film or curtain from the uppermost tray to the tray therebeneath in an alternating manner from the outer peripheral edge to the inner peripheral edge. The generator provides for an increase in the steam generator output for a given tray size. The top tray of each pair of trays may be shaped to have an outer peripheral overflow edge and the bottom tray of each pair may have an inner peripheral overflow edge.

11 Claims, 5 Drawing Figures

TRAY ELECTRODE ARRANGEMENT FOR AN ELECTRICAL STEAM OR HOT WATER GENERATOR

This invention relates to an electrical hot water generator, more particularly to an electrical steam generator.

Heretofore, various types of electrical steam generators have been known. Generally, the generators have been constructed so that water can be directed to fall from a water distribution device in a stream or film onto an electrode in order to generate steam. In some cases, for example as described in Swiss Pat. No. 612,491, an electrical steam generator has been constructed of a pressure vessel in which two trays are disposed one above the other on at least one substantially vertical spindle. In addition, one tray is electrically insulated from the pressure vessel wall and is connected to a power supply while the other tray is electrically connected to the pressure vessel wall. A means is also provided to pump water from a sump in the pressure vessel into the top tray. The trays are further arranged so that water flows in the form of a film from the top tray to the bottom tray and then from the bottom tray into the sump. In this construction, the cross-section of the falling water and, hence, the output of the steam or vapor generator, is directly dependent upon the tray diameter. In this respect, a single tray and a single overflow is used.

Generally, the thickness of the falling stream of water in the above types of steam generators must not exceed a certain value because a thicker curtain of water would result in water splashing and this must be avoided.

Accordingly, it is an object of the invention to provide an electrical steam generator which can provide a higher output for a given tray size.

It is another object of the invention to reduce the investment cost per kilowatt hour for an electrical steam generator.

It is another object of the invention to be able to vary the output of an electrical steam generator for a given tray size.

Briefly, the invention provides an electrical steam generator which is comprised of a pressure vessel having a sump therein, at least one vertical spindle within the pressure vessel, at least two pairs of trays disposed about the spindle in vertically disposed relation and means for conveying water from the sump to the top tray of the top pair of trays.

In accordance with the invention, the trays are disposed to permit water to flow in the form of a film from a top tray of a top pair of trays to a bottom tray of said top pair and then from the bottom tray of said top pair of trays to a top tray of a pair of trays therebeneath and from the bottom tray of the bottom pair of trays into the sump.

One advantage of the steam generator is that the driving power required for conveying the water from the sump is considerably reduced per converted kilowatt-hour. Further, the construction of the means for conveying the water can be reduced because the amount of water which is circulated is reduced.

In comparison with the known embodiments, for example as described in Swiss Patent 612,491 wherein overflows are formed by straight or involute slits in the trays, the trays of the steam generator are of simple construction and of the type that can be manufactured for lower output steam or vapor generators.

In order to occupy a very small space, the trays disposed beneath the top tray of the top pair of trays are annular and are shaped to cause water to flow alternately outwards and inwards over the edges of the trays.

The generator may be constructed such that the vertical spindle is a riser which communicates with and which supports the top tray of the top pair of trays while also communicating with the means for conveying water from the sump. Where the means for conveying the water includes a pump, the driving power required for pumping the water is low because the water is fed over the shortest distance to the top tray via the riser. Further, in this construction, the riser can support each top tray of each pair of trays while being disposed centrally of the trays. In addition, at least one carrier rod can be used to support a bottom tray of each pair of trays in electrically insulated manner from the pressure vessel. In this respect, only three carrier rods are required. Further, these rods can be used for the power supply.

In one embodiment, three risers may be disposed within the pressure vessel with pairs of trays disposed about each riser. In this embodiment, means can be provided to connect one phase of a three-phase power supply to a respective riser. Further, by providing an adjustable throttle valve in at least two of the risers, it is possible to use a single circulating pump for feeding water to the three risers, for example, via a distributor pipe communicating the pump with the risers.

In order to prevent falling water from breaking up excessively into droplets at low load, since this might result in splashing, each tray has an overflow edge which is disposed in a plane parallel to the plane of an overflow edge of the remaining trays and inclined to a horizontal plane. This also provides a weak point at the periphery of the falling film of water so that steam which forms on the inside of the film can escape through this weak point into the space outside the film.

In another embodiment, the pressure vessel can be made of slender construction with a single riser therein. In this case, the pairs of trays are disposed about the riser with the bottom tray of each pair of trays supported on a carrier rod in electrically insulated manner from the vessel. Suitable means also connect each carrier rod to a different phase of a three-phase power supply. In this construction, the pressure vessel may have a correspondingly reduced wall thickness.

The trays of the steam generator may be made vertically adjustable relative to the riser. This enables the power of the individual phases to be equalized. To this end, the distances between each two upper trays can be increased so that the resistance between each two vertically adjacent trays remains constant although a smaller quantity of water flows in the region of the bottom trays.

The steam generator may also be provided with a means for feeding additional water to the bottom tray of at least the bottom pair of trays from the sump and parallel with the top tray of the top pair of trays. This additional water supply enables water which is evaporated in the upper sections of the falling water to be replaced for the purpose of adjusting the resistances of the layers of water.

These and other objects and advantages of the invention will become more apparent from the following detailed description taken in conjunction with the accompanying drawings wherein.

Figure 1:
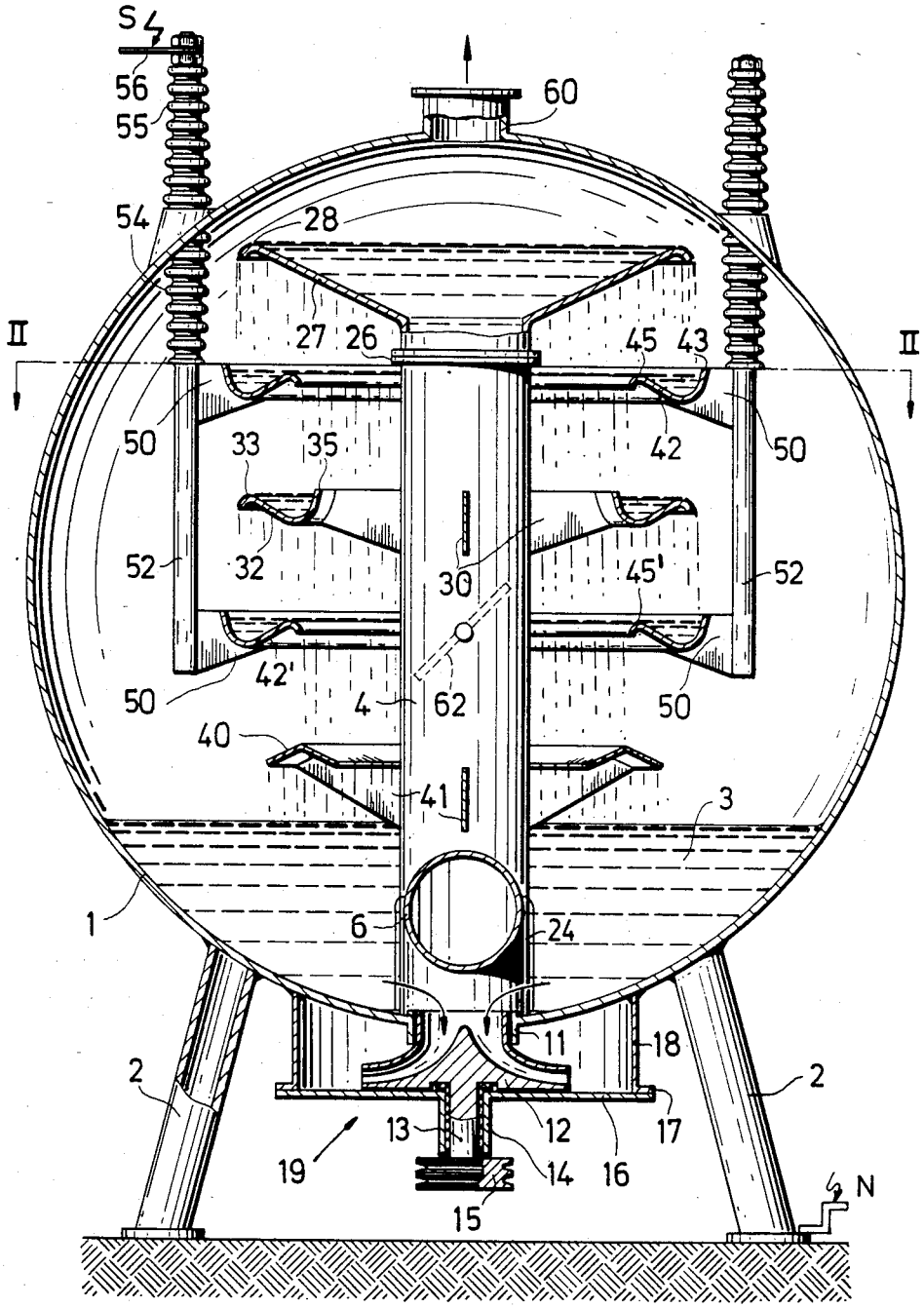
FIG. 1 illustrates a diagramatic vertical sectional view taken on line I—I of FIG. 5 through an electrical steam generator constructed in accordance with the invention.
Figure 2:
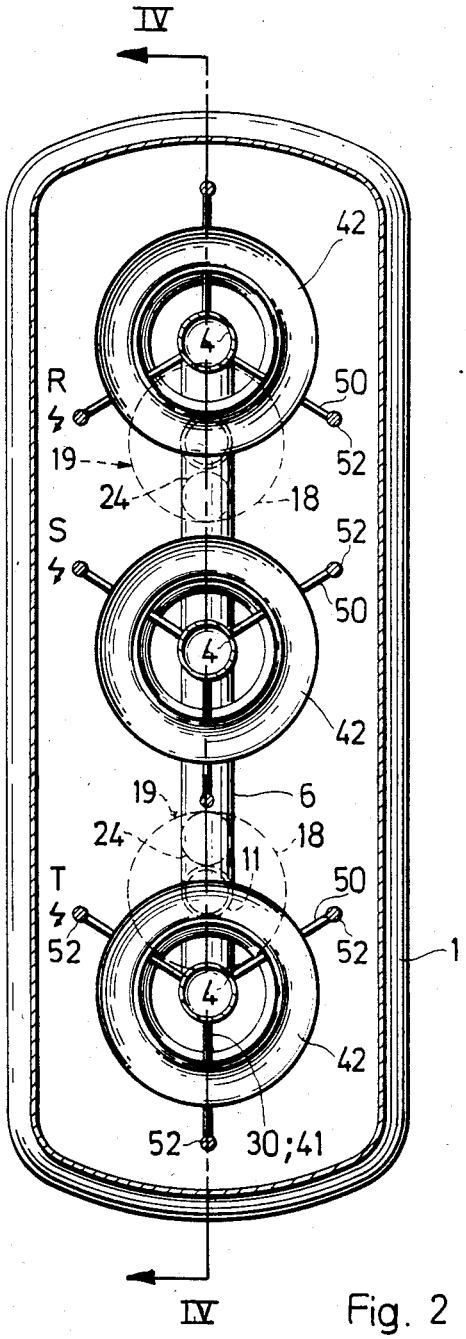
FIG. 2 illustrates a view taken on line II—II of FIG. 1.
Figure 5:
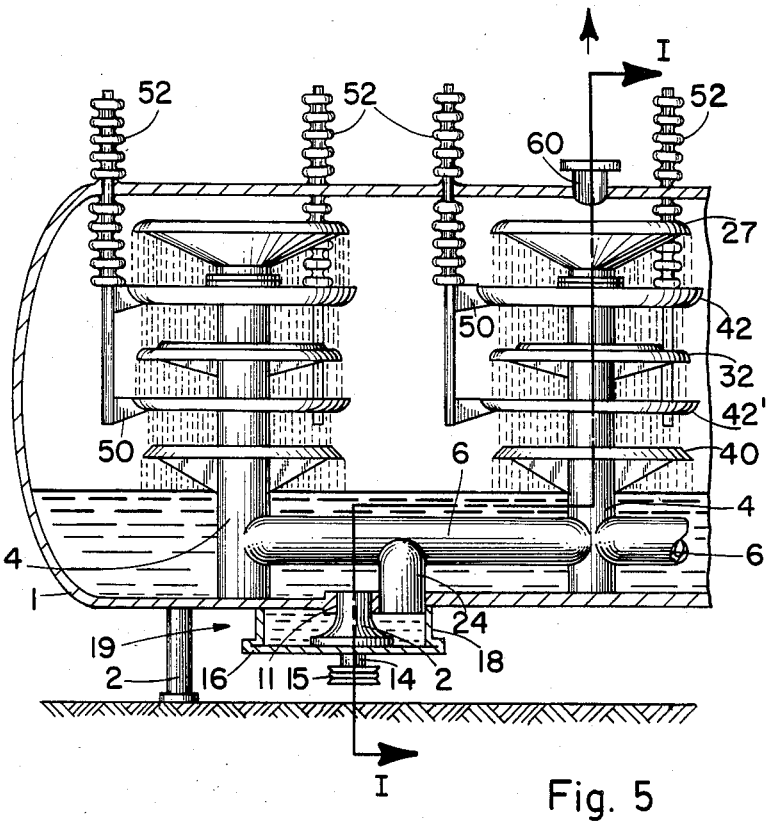
FIG. 5 illustrates a view taken on line V—V of FIG. 2.

Referring to FIGS. 1, 2 and 5, the electrical steam generator includes a cylindrical pressure vessel 1 which is disposed on a horizontal axis and which has a plurality of legs 2 for supporting the vessel 1 on a suitable support and a sump 3 therein at the bottom for receiving a supply of water. In addition, three vertically disposed risers 4 are disposed consecutively in the longitudinal direction of the vessel and are rigidly welded in the base of the vessel.

The steam generator is provided with pairs of trays which are disposed about each riser 4 in vertically disposed relation to receive a flow of water from a tray thereabove. As indicated in FIG. 1, the top end of each riser 4 is provided with a flange 26 on which a flat tray 27 with a radiused outer edge 28 is secured. As shown, the tray 27 is of generally conical shape while the outer edge 28 forms a horizontal overflow for water which rises within the tray 27. An annular tray 42 is disposed below the overflow edge 28 of the top tray 27 to receive a flow of water in the form of a film therefrom. This pair of trays 27, 42 is followed by a second pair of trays 32, 42'.

As indicated in FIG. 1, the top tray 32 of the lower pair of trays is shaped with an outer peripheral edge 33 to permit a flow of water thereover onto the bottom tray 42'. The inner peripheral edge 35 of the tray 32 terminates at a higher level than the radiused overflow edge 33. To this end, the tray 32 has a cross-sectional shape in the form of a horizontal S.

The bottom tray 42 of the top pair of trays is also in the shape of a horizontal S and has an inner peripheral edge 45 to permit a flow of water thereover onto the tray 32. The outer peripheral edge 43 of the tray 42 terminates at a higher level than the overflow edge 45. The annular tray 42' is of the same construction as the annular tray 42.

As indicated in FIG. 1, the trays 27, 42, 32, 42' are shaped to cause water to flow alternately outwards and inwards over the edges of the trays.

Referring to FIG. 1, the annular tray 32 is supported on and is electrically connected to the riser 4 somewhat above half the height of the riser by means such as three arms 30. The bottom trays 42, 42' are supported about the riser 4 in spaced relation by means of three carrier rods 52 via webs 50. Each carrier rod 52 is secured to the pressure vessel 1 so as to be electrically insulated with the interposition of an inner and outer insulating sleeve 54, 55. In this way, the bottom tray of each pair of trays is electrically insulated from the pressure vessel 1.

A means in the form of a busbar 56 is provided for connecting one phase of a three-phase power supply to a respective riser 4. As indicated in FIG. 1, the busbar 56 is connected outside of the pressure vessel 1 to each one of the carrier rods 52 extending through the vessel 1 so as to connect each rod 52 to a respective phase R, S, T (see FIG. 2). The pressure vessel 1 is connected to a neutral conductor of the three-phase power supply.

A sheet-metal ring 40 is provided about the lower half of each riser 4 and has a roof-shaped cross-section. As shown in FIG. 1, each ring 40 is supported on and electrically connected to the riser 4 via three carrier arms 41. In addition, each ring 40 is positioned below the bottom tray 42' so as to receive a film of water from the overflow edge 45' thereof.

As indicated in FIG. 1, the annular tray 42 is located at substantially half the height between the overflow edge 28 of the top tray 27 and the overflow edge 33 of the annular tray 32 while being arranged in mirror-image fashion to the shape of the annular tray 32. Likewise, the annular tray 42' is disposed about the riser 4 between the annular tray 32 and the ring 40.

Referring to FIGS. 1, 2 and 5, the steam generator also has means for conveying water from the sump 3 to the top tray 27 of the top pair of trays. To this end, the conveying means includes a pair of circulating pumps 19 below the sump 3 and a distributor pipe 6 which communicates the pumps 19 with the risers 4. As shown in FIG. 5, the distributor pipe 6 extends longitudinally within the bottom part of the pressure vessel 1.

Referring to FIGS. 1 and 5, each circulating pump 19 includes a short length tubing 11 which is welded into the base of the pressure vessel 1 and an impeller 12 which is rotatably disposed within the tubing 11. The impeller 12 is mounted on a shaft 13 which, in turn, is mounted in a bush 14 and which carries a V-belt pulley 15 at the lower free end. The bush 14 is secured to a cover 16 which is secured in seal-tight relationship to a connecting flange 17 of a spigot 18 which, in turn, is welded to the outside of the pressure vessel 1 to surround the impeller 12. As indicated in FIG. 5, a connecting tube 24 extends from the annular space between each tubing 11 and the associated spigot 18 to the distributor pipe 6. In this way, water from the sump 3 can be circulated through the impeller 12 into the spigot 18 and thence via the connecting tubes 24 to the distributor pipe 6.

The two circulating pumps 19 are driven at variable speed by driving motors (not shown) and V-belts (not shown) which cooperate with the pulleys 15 so that water is feed from the sump 3 via the distributor pipe 6 to the three risers 4.

As shown in FIG. 1, the pressure vessel 1 has a steam or vapor discharge spigot 60 at the top. In addition, a feed water supply spigot (not shown), at least one sludge removal spigot and, possibly, a degassing spigot (not shown) are also connected to the pressure vessel 1. Finally, an adjustable throttle valve 62 is provided in at least two of the risers 4.

The electrical steam generator operates as follows. During operation, the two circulating pumps 19 are driven so that water is fed from the sump 3 to the uppermost trays 27 via the three risers 4. The water then flows from each tray 27 over the overflow edge 28 onto an annular tray 42 therebelow so that a water level is formed therein. The water then flows over the inner peripheral edge 45 onto the annular tray 32 in which a water level is also formed. Thereafter, the water flows over the outer peripheral edge 33 onto the annular tray 42' where a level of water is again formed. The water then flows out of the annular tray 42' over the inner overflow edge 45' onto the sheet metal ring 40 and then flows back to the sump 3. The arrangement of the trays is such that the water flows in the form of a film from a bottom tray of a top pair of trays to the top tray of the pair of trays therebeneath and then finally from the bottom tray on the bottom pair of trays into the sump 3.

During operation of the steam generator, current from the three-phase power supply extends from the annular trays 42, 42' up to the trays 27, 32 and down to the annular tray 32 and to the sheet metal ring 40. The current then flows via the risers 4 back to the wall of the pressure vessel 1. As a result of the free heights of fall of the water between the trays 27 and 42; 42 and 32; 32 and 42'; and between the tray 42 and the ring 40—which heights of fall are made substantially equal—and as a result of the amount of water throughput and the conductivity to which the water has been adjusted, each of the three electrode systems has a certain resistance. Further, these resistances can be balanced relative to one another by adjustment of the throttle valves 62 in the risers 4.

As a result of the current flow, the water contained in the pressure vessel 1 is initially heated and is also evaporated, if required, and if the water supply and discharge are appropriately adjusted. As a result, a required pressure and associated saturated steam temperature can be obtained.

Figure 3:
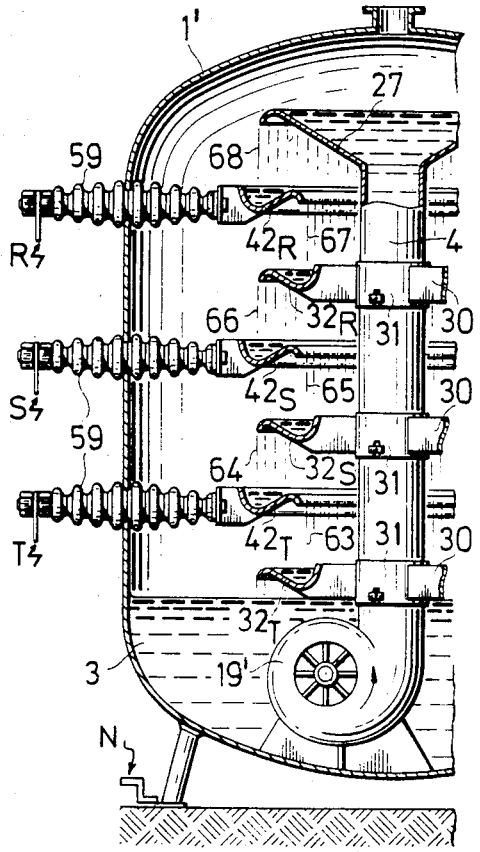
FIG. 3 illustrates a part vertical cross-section of a modified electrical steam generator constructed in accordance with the invention having a single riser.

Referring to FIG. 3 wherein like reference characters indicate like parts as above, the pressure vessel 1' can be disposed on a vertical axis. In this regard, the pressure vessel 1' contains only one riser 4 which is fed with water from a sump 3 at the bottom by means of a circulating pump 19' disposed in the sump 3. As in the above described embodiment, the riser 4 carries a top tray 27. In addition, three annular trays 42R, 42S, 42T are disposed about the riser 4 and are carried by radially disposed carrier rods which extend through insulating sleeves 59 mounted in the sidewall of the pressure vessel 1'. In addition, each tray 42R, 42S, 42T is secured to the carrier rod in an adjustable manner so that a respective tray 42R, 42S, 42T can be vertically adjusted along the height of the riser 4. Means are also provided to connect each of the annular trays 42R, 42S, 42T to the three phases R, S, T of a three-phase power supply. As shown in FIG. 3, an annular tray 32R, 32S, 32T is disposed beneath each annular tray 42R, 42S, 42T and is connected by an arm 30 to a collar 31 which is secured to the riser 4. The trays 32R, 32S, 32T could be secured to the riser 4 also in a vertical by adjustable manner.

As illustrated, there are three pairs of trays on the riser 4 which are vertically disposed one above the other. Also, as above, the trays are disposed to permit water to flow in the form of a film from a bottom tray of a top pair of trays to a top tray of a pair of trays therebeneath in an alternating manner outwards and inwards over the peripheral edges of the respective trays.

The heights of fall of the water can be adjusted by vertical adjustment of the annular trays 42R, 42S, 42T so that the resistances in the three phases become equal despite a decreasing quantity of water from top to bottom due to evaporation. Thus, an uneven loading of the three phases can be avoided, at least for a specific load.

The construction illustrated in FIG. 3 is particularly favorable with respect to the overall volume since the pressure vessel 1' can be made slender and relatively light in weight.

During generator operation, the current of phase R flows from tray 42R through water curtains 67, 68 to the trays 32R, 27; the current of phase S flows from tray 42S through water curtains 65, 66 to the respective trays 32S, 32R; and the current of phase T flows from tray 42T through water curtain 63, 64 to the respective trays 32T, 32S.

The quantities of water which are evaporated during operation can be compensated for by transferring additional water from the riser 4 directly into the trays 42S, 42T, for example by means of adjustable throttle means (not shown) instead of by adjusting the height of these trays.

Figure 4:
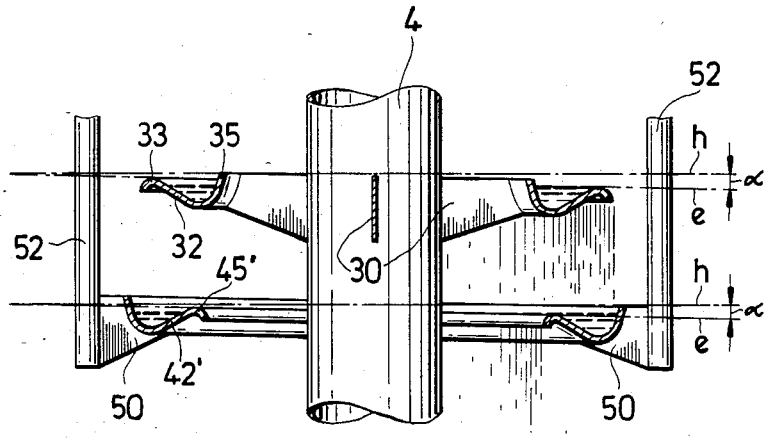
FIG. 4 illustrates a modified arrangement of the trays about a riser in accordance with the invention.

Referring to FIG. 4 wherein like reference characters indicated like parts as above, all of the trays which are disposed about a vertical spindle 4 (only the annular trays 32 and 42' being shown for simplicity) can be slightly inclined to the horizontal so that the overflow edges 33, 45' of the trays extend in parallel planes e which are slightly inclined to the horizontal h. As indicated, the planes e and h include an angle $\alpha$, which is shown on an exaggerated scale in FIG. 4. This inclination of the trays has the effect that as the steam generator load decreases, the water flowing in a film over the overflow edges 33 and 45' is concentrated on the right-hand part, as viewed, of the periphery of each tray. As a result, the film of water on the part of the periphery over which the water flows is thick enough not to break up into drops as would be case with a horizontal position of the overflow edges. The inclination of the trays also produces a weak point or opening in the water film on the left-hand part of the periphery, as viewed, so that steam or vapor forming on the inside of the film can escape through this opening into the space outside the film.

Of note, the embodiment illustrated in FIG. 4 may be used in each of the steam generator constructions illustrated in FIGS. 1 and 3 above.

As an alternative, the effect of inclining the trays to the horizontal can also be achieved by arranging the overflow edges at right angles to the longitudinal axis of the riser 4 and inclining this axis by the angle $\alpha$ to the vertical. In this way, either the internal fittings inside the pressure vessel or the pressure vessel together with the internal fittings is at an inclination.

The invention thus provides an electrical steam generator which is capable of relatively high outputs for a given tray size. In addition, the invention provides an electrical steam generator which can be constructed at reduced investment costs per kilowatt hour while providing relatively high output. Further, the invention provides a steam generator which can be adjusted to vary the output while using the same tray size.

What is claimed is:

1. An electrical hot water generator or steam generator comprising a pressure vessel having a sump therein;

a vertical riser within said pressure vessel;

at least two pairs of spaced electrically conductive trays disposed about said riser in vertically disposed relation, said trays each having a peripheral overflow edge disposed to permit water to flow thereover in the form of a film from the top tray of the top pair of trays to the bottom tray of said top pair and then from the bottom tray of said top pair of trays to the top tray of the pair of trays therebeneath and from the bottom tray of the bottom pair of trays into said sump with said top tray of each said pair of trays being electrically insulated from said bottom tray of said respective pair of trays; and means for conveying water from said sump to the top tray of said top pair of trays.

2. An electrical generator as set forth in claim 1 wherein said trays disposed beneath the top tray of said top pair of trays are annular and are shaped to cause water to flow alternately outwards and inwards over said edges of said trays.

3. An electrical generator as set forth in claim 2 wherein said riser communicates with and supports said top tray of said top pair of trays and communicates with said means for conveying water from said sump, said riser supporting the top tray of each pair of trays thereon and being disposed centrally of said trays.

4. An electrical generator as set forth in claim 3 which further comprises at least one carrier rod supporting the bottom tray of each said pair of trays in electrically insulated manner from said vessel and said riser.

5. An electrical generator as set forth in claim 3 further comprising three of said risers; two pairs of said trays disposed about each riser; means connecting one phase of a three-phase power supply to a respective riser; an adjustable throttle valve in at least two of said risers; and wherein said means for conveying water includes at least one circulating pump in said sump and a distributor pipe communicating said at least one pump to said risers.

6. An electrical generator as set forth in claim 1 wherein each said tray has an overflow edge disposed in a plane parallel to the plane of an overflow edge of the remaining trays and inclined to a horizontal plane.

7. An electrical generator as set forth in claim 1 further comprising three pairs of said trays disposed above said riser, a carrier rod supporting the bottom tray of each said pair of trays in electrically insulated manner from said vessel, and means connecting a respective carrier rod to a different phase of a three-phase supply.

8. An electrical generator as set forth in claim 7 wherein at least some of said trays are vertically adjustable relative to said spindle.

9. An electrical hot water generator or steam generator comprising a pressure vessel having a sump therein for water;

a vertical riser within said pressure vessel and extending from said sump;

at least two pair of spaced electrically conductive trays disposed about said riser in vertically disposed relation to receive a flow of water from a tray thereabove, the top tray of each said pair of trays being supported on and electrically connected to said riser and being shaped with an outer peripheral edge to permit a flow of water thereover onto the bottom tray therebelow and each said bottom tray being shaped with an inner peripheral edge to permit a flow of water thereover onto the top tray therebelow;

means supporting the bottom tray of each said pair of trays in electrically insulated manner from said vessel and said riser; and means for conveying water from said sump through said riser to the top tray of the top pair of trays.

10. An electrical generator as set forth in claim 9 wherein said means supporting the bottom tray of each pair of trays includes a rod connected to said bottom tray and extending through said pressure vessel for connection to a power supply.

11. An electrical generator as set forth in claim 9 wherein said means for conveying water from said sump includes a pump.

* * * * *

UNITED STATES PATENT AND TRADEMARK OFFICE

CERTIFICATE OF CORRECTION

PATENT NO. : 4,577,091

DATED : March 18, 1986

INVENTOR(S) : ALBERT KUNZLI

It is certified that error appears in the above-identified patent and that said Letters Patent is hereby corrected as shown below:

Column 4, line 5 change "conductor" to -conductor N-

Column 4, line 48 change "feed" to -fed-

Column 5, line 50 change "vertical by" to -vertically-

Column 6, line 15 change "indicated" to -indicate-

Column 6, line 16 change "spindle 4" to -riser 4-

Signed and Sealed this

*Second* Day of *September 1986*

[SEAL]

*Attest:*

DONALD J. QUIGG

*Attesting Officer*

*Commissioner of Patents and Trademarks*